US010101697B2

(12) United States Patent
Matsuura

(10) Patent No.: US 10,101,697 B2
(45) Date of Patent: Oct. 16, 2018

(54) IMAGE FORMING APPARATUS

(71) Applicant: CANON KABUSHIKI KAISHA, Tokyo (JP)

(72) Inventor: Taisuke Matsuura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/602,942

(22) Filed: May 23, 2017

(65) Prior Publication Data

US 2017/0343944 A1 Nov. 30, 2017

(30) Foreign Application Priority Data

May 31, 2016 (JP) ..... 2016-109323
Feb. 28, 2017 (JP) ..... 2017-037666

(51) Int. Cl.

| | |
|---|---|
| ***G03G 15/00*** | (2006.01) |
| ***G03G 15/06*** | (2006.01) |
| ***G03G 15/16*** | (2006.01) |
| ***G03G 15/01*** | (2006.01) |
| *G03G 13/22* | (2006.01) |
| *G03G 15/02* | (2006.01) |

(52) U.S. Cl.

CPC ..... *G03G 15/50* (2013.01); *G03G 15/0136* (2013.01); *G03G 15/0189* (2013.01); *G03G 15/065* (2013.01); *G03G 15/1615* (2013.01); *G03G 15/1665* (2013.01); *G03G 15/1675* (2013.01); *G03G 13/22* (2013.01); *G03G 15/0266* (2013.01)

(58) Field of Classification Search

CPC ..... G03G 13/22; G03G 15/0178; G03G 15/0189; G03G 15/0266; G03G 15/1605; G03G 15/1615; G03G 15/50

USPC ..... 399/38, 46, 50, 53, 55, 66, 82, 85

See application file for complete search history.

(56) References Cited

U.S. PATENT DOCUMENTS 6,934,497 B2 8/2005 Hagiwara et al.
2007/0292170 A1* 12/2007 Yoshioka ..... G03G 15/0131 399/299

(Continued)

FOREIGN PATENT DOCUMENTS

JP 2003-280318 A 10/2003
JP 2003-337454 A 11/2003

(Continued)

*Primary Examiner* — Benjamin Schmitt

(74) *Attorney, Agent, or Firm* — Fitzpatrick, Cella, Harper & Scinto

(57) ABSTRACT

An image forming apparatus includes a first image bearing member, a second image bearing member, an intermediate transfer belt, a first primary transfer member, a second primary transfer member, a secondary transfer outer member, a pre-secondary transfer stretch roller, a driving roller, and an execution portion. The execution portion is configured to execute a first monochromatic mode in which a bias smaller than the primary transfer bias applied to the first primary transfer member in a case where a toner image is formed on the first image bearing member is applied to the first primary transfer member, and the primary transfer bias applied to the second primary transfer member in a case where a toner image is formed on the second image bearing member is applied to the second primary transfer member.

9 Claims, 10 Drawing Sheets

(56) References Cited

U.S. PATENT DOCUMENTS

| | | | | |
|---|---|---|---|---|
| 2010/0303488 | A1* | 12/2010 | Yanagi | G03G 15/065<br>399/45 |
| 2016/0085193 | A1* | 3/2016 | Yuasa | G03G 15/5008<br>399/39 |
| 2016/0139531 | A1* | 5/2016 | Shimazoe | G03G 15/0266<br>399/50 |

FOREIGN PATENT DOCUMENTS

| | | | |
|---|---|---|---|
| JP | 2008-111885 | A | 5/2008 |
| JP | 2011-170215 | A | 9/2011 |
| JP | 2013-109378 | A | 6/2013 |

* cited by examiner

IMAGE FORMING APPARATUS

BACKGROUND OF THE INVENTION

Field of the Invention

The present invention relates to an image forming apparatus utilizing an electrophotographic process such as a copier, a printer, a facsimile machine, or a multifunctional apparatus implementing these functions.

Description of the Related Art

Conventionally, various image forming apparatuses utilizing an electrophotographic system or an electrostatic recording system have been developed. Among these, an image forming apparatus employing a tandem system is known as an apparatus capable of forming a full-color image quickly. The image forming apparatus employing a tandem system is configured such that process cartridges respectively configured to form images of different colors are arranged in a line and the images of respective colors are transferred onto an intermediate transfer belt through primary transfer. Various kinds of image information have come to be treated due to the development of an information society, and the image forming apparatus employing a tandem system is increasingly utilized not as an exclusive printing apparatus for full-color printing but as a general-purpose apparatus that can be also used for monochromatic printing.

Japanese Patent Laid-Open No. 2003-337454 proposes an image forming apparatus employing a tandem system configured to separate other photosensitive drums than a photosensitive drum for black toner from an intermediate transfer belt when performing printing by using only black toner.

Japanese Patent Laid-Open No. 2013-109378 proposes an image forming apparatus employing a tandem system configured to bring also other photosensitive drums than a photosensitive drum for black toner into contact with an intermediate transfer belt and apply a bias also to other primary transfer portions than a primary transfer portion for black toner when performing printing by using only black toner.

In the case of printing a black and white image by using an image forming apparatus employing a tandem system, separating the other photosensitive drums than the photosensitive drum for black toner from the intermediate transfer belt as proposed in Japanese Patent Laid-Open No. 2003-337454 has a merit that the photosensitive drums are prevented from wearing while being separated from the intermediate transfer belt. However, in this system, the intermediate transfer belt and the photosensitive drums are required to be brought into contact with or separated from each other each time printing of a full-color image and printing of a black and white image are switched, and thus the printing throughput is restricted by operation time of a contact/separation mechanism.

Therefore, in some cases, a black and white image is printed with the other photosensitive drums than the photosensitive drum for black toner in contact with the intermediate transfer belt even when performing printing by using only black toner. In addition, there is a configuration employing a direct current charging system, in other words, a DC charging system, as a system for electrifying a photosensitive drum. In the DC charging system, only a DC voltage is applied for charging. Charging performance and the degree of convergence of potential of the DC charging system are low compared with a system in which an alternate current voltage, in other words, an AC voltage, is superposed on a DC voltage, and thus a case where the DC voltage is applied to an image forming portion in which image formation is not performed can be considered. In this case, if a primary transfer bias is not applied between the photosensitive drum and the intermediate transfer belt, a charging potential of the photosensitive drum will be deviated from a desired potential. This may cause, for example, carrier attachment in which carrier attaches to a photosensitive drum.

There is a configuration in which the peripheral speed of an intermediate transfer belt is set to be faster than the peripheral speed of a photosensitive drum. In the case where a primary transfer bias is applied in this configuration, a larger load is put on a driving roller that drives the intermediate transfer belt due to an electrostatic attraction force between the intermediate transfer belt and the photosensitive drum. Further, in the case where a slip occurs between the driving roller and the intermediate transfer belt and thus the speed of the intermediate transfer belt becomes lower than the speed of the photosensitive drum, the intermediate transfer belt may be loosened in a region upstream of a secondary transfer nip portion and thus an abnormal image may be formed due to an abnormal electric discharge at the secondary transfer nip portion.

SUMMARY OF THE INVENTION

According to one aspect of the present invention, an image forming apparatus includes a first image bearing member, a second image bearing member, a first charging member, a second charging member, a first developing sleeve, a second developing sleeve, a first developing bias power source, a second developing bias power source, an intermediate transfer belt, a first primary transfer member, a second primary transfer member, a secondary transfer outer member, a pre-secondary transfer stretch roller, a driving roller, and an execution portion. The first image bearing member and the second image bearing member each are configured to rotate while bearing a toner image. The first charging member and the second charging member are configured to respectively electrify surfaces of the first image bearing member and the second image bearing member via a DC charging method. The first developing sleeve and the second developing sleeve each are configured to rotate while bearing toner thereon. The first developing bias power source is configured to apply a developing bias to the first developing sleeve to develop a toner image on the first image bearing member. The second developing bias power source is configured to apply a developing bias to the second developing sleeve to develop a toner image on the second image bearing member. The intermediate transfer belt is configured as an endless belt and is configured to come into contact with the first image bearing member and the second image bearing member on an outer peripheral surface thereof. The first primary transfer member and the second primary transfer member are disposed in a space enclosed by the intermediate transfer belt and are configured to respectively transfer, by being subjected to a primary transfer bias applied thereto, toner images formed on the first image bearing member and the second image bearing member onto the intermediate transfer belt. The secondary transfer outer member is configured to form, with the outer peripheral surface of the intermediate transfer belt, a secondary transfer nip portion that nips a recording material, and transfer, by being subjected to a secondary transfer bias applied thereto, toner images transferred onto the intermediate transfer belt onto the recording material. The pre-secondary transfer stretch roller is disposed in a position downstream of the first primary transfer member and the second primary transfer member and upstream of the secondary transfer nip portion in a rotation direction of the intermediate transfer belt, and is configured to stretch the intermediate transfer belt by being in contact with an inner peripheral surface of the intermediate transfer belt. The driving roller is disposed downstream of the pre-secondary transfer stretch roller and is configured to stretch the intermediate transfer belt and transmit a driving force to the intermediate transfer belt by being in contact with the inner peripheral surface of the intermediate transfer belt while rotating at a peripheral speed faster than peripheral speeds at which the first image bearing member and the second image bearing member rotate. The execution portion is configured to, in a case of forming a toner image on the second image bearing member without forming a toner image on the first image bearing member and transferring the toner image formed on the second image bearing member onto the recording material via the intermediate transfer belt, execute a first monochromatic mode in which, with the first image bearing member and the second bearing member in contact with the intermediate transfer belt, the DC charging bias is applied to the first charging member and the second charging member, rotation of the first developing sleeve is stopped, the second developing sleeve is caused to rotate, the first developing bias power source applies a predetermined developing bias to the first developing sleeve, the second developing bias power source applies a predetermined developing bias to the second developing sleeve, a bias smaller than the primary transfer bias applied to the first primary transfer member in a case where a toner image is formed on the first image bearing member is applied to the first primary transfer member, and the primary transfer bias applied to the second primary transfer member in a case where a toner image is formed on the second image bearing member is applied to the second primary transfer member.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Configuration of Apparatus

Figure 9:
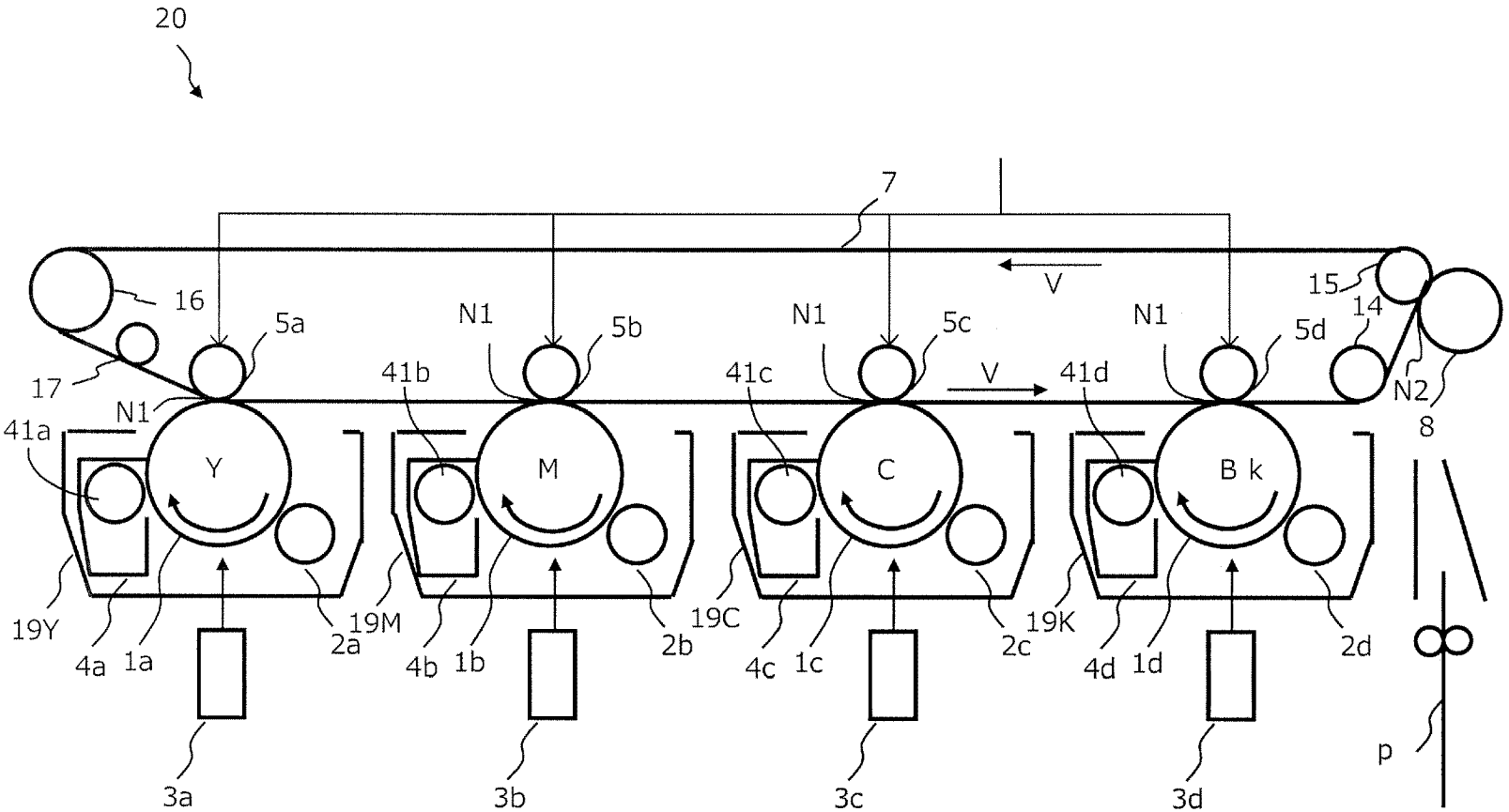
FIG. 9 is a schematic configuration diagram of a typical image forming apparatus employing a tandem system.

FIG. 9 illustrates an exemplary image forming apparatus employing a tandem system including image forming portions of four colors arranged on an intermediate transfer belt.

For convenience of description, colors corresponding to respective printing portions constituting the tandem system will be described as yellow, magenta, cyan, and black. These four colors may be also respectively described as Y, M, C, and Bk. In addition, an example in which four colors of yellow, magenta, cyan and black are used for full-color printing and only black is used for monochromatic printing will be described. However, the number, colors, arrangement, and use of printing portions are not limited to this exemplary embodiment.

An image forming apparatus 20 illustrated in FIG. 9 includes four stations of an image forming portion 19Y, an image forming portion 19M, an image forming portion 19C, and an image forming portion 19K, and these four image forming portions are arranged in a line with constant intervals therebetween. The image forming portion 19Y forms an image with yellow toner, the image forming portion 19M forms an image with magenta toner, the image forming portion 19C forms an image with cyan toner, and the image forming portion 19K forms an image with black toner.

The image forming portions 19Y, 19M, 19C, and 19K respectively include photosensitive drums 1*a*, 1*b*, 1*c*, and 1*d*, charging rollers 2*a*, 2*b*, 2*c*, and 2*d*, and exposing units 3*a*, 3*b*, 3*c*, and 3*d*. The photosensitive drums 1*a* to 1*d* each serve as an image bearing member configured to rotate, and the charging rollers 2*a* to 2*d* respectively electrify the photosensitive drums 1*a* to 1*d*. The exposing units 3*a* to 3*d* serve as exposing portions configured to respectively expose the photosensitive drums 1*a* to 1*d* that have been electrified to form latent images.

The image forming portions 19Y to 19K further respectively include developing units 4*a*, 4*b*, 4*c*, and 4*d* and primary transfer rollers 5*a*, 5*b*, 5*c*, and 5*d*.

The developing units 4*a* to 4*d* serve as developing portions configured to develop respective latent images formed on the photosensitive drums 1*a* to 1*d* as toner images. The developing units 4*a* to 4*d* respectively include developing sleeves 41*a* to 41*d* and developing bias power sources that are not illustrated.

Primary transfer biases for transferring the toner images respectively formed by the developing units 4*a* to 4*d* from the photosensitive drums 1*a* to 1*d* onto the intermediate transfer belt 7 through primary transfer at primary transfer nip portions N1 serving as primary transfer positions through primary transfer are applied to the primary transfer rollers 5*a* to 5*d*.

The image forming apparatus 20 illustrated in FIG. 9 may include a contact/separation mechanism for separating the intermediate transfer belt 7 and the photosensitive drums 1*a* to 1*d* from each other as necessary.

The surfaces of photosensitive drums 1*a* to 1*d* configured to rotate in directions indicated by arrows in FIG. 9 are respectively uniformly electrified by the charging rollers 2*a* to 2*d*. Then, electrostatic latent images corresponding to respective colors are formed by the exposing units 3*a* to 3*d* irradiating the electrified photosensitive drums 1*a* to 1*d* with light modulated in accordance with image signals of respective colors. The electrostatic latent images formed on the photosensitive drums 1*a* to 1*d* are respectively developed as toner images of respective colors on the photosensitive drums 1*a* to 1*d* by the developing units 4*a* to 4*d*.

Then, the toner images of respective colors are transferred onto the intermediate transfer belt 7 by the primary transfer rollers 5*a* to 5*d* to which predetermined pressurizing forces and the primary transfer biases are applied.

In this way, toner images of different colors are sequentially transferred onto the intermediate transfer belt 7 so as to be superposed on one another, and thus a full-color image is formed on the intermediate transfer belt 7. Although the number of colors used in the apparatus illustrated in FIG. 9 is four, the number of colors is not limited to four, and the arrangement order of colors is neither limited to the order of the exemplary embodiment.

The intermediate transfer belt 7 is configured as a rotatable endless belt for conveying a toner image, and is stretched by plural rollers.

The intermediate transfer belt 7 is stretched by a driving roller for transmitting a driving force to rotate the intermediate transfer belt 7. In addition, the intermediate transfer belt 7 is stretched by a secondary transfer inner roller that supports the inner peripheral surface of the intermediate transfer belt 7 at a secondary transfer nip portion N2. Although a single secondary transfer inner roller is used as both of the driving roller and the secondary transfer inner roller in the apparatus illustrated in FIG. 9, separate rollers may be individually provided for these functions. Further, a tension roller 16 and stretch rollers 14 and 17 may be provided. The tension roller 16 imparts a predetermined tension force to the intermediate transfer belt 7. The positions and number of the rollers stretching the intermediate transfer belt 7 are not limited to the example illustrated in FIG. 9.

The toner image formed on the intermediate transfer belt 7 is conveyed to the secondary transfer nip portion N2 serving as a secondary transfer portion. The toner image including toner images of respective colors formed on the intermediate transfer belt 7 is transferred onto a recording material P at the secondary transfer nip portion N2.

Condition Causing Bk Image Defect

In the description below, a control sequence of performing full-color printing will be referred to as a full-color mode, and a control sequence of performing monochromatic printing will be referred to as a monochromatic mode.

In an image forming apparatus employing a tandem system exemplified in FIG. 9, a phenomenon in which a part of a Bk image is omitted when performing printing in a monochromatic mode using only Bk may occur. Conditions causing this phenomenon will be described below.

Condition 1: Photosensitive drums for Y, M, and C are in contact with an intermediate transfer belt, and primary transfer biases equal to or higher than primary transfer biases for the full-color mode are applied to primary transfer rollers for Y, M, and C.

Condition 2: A pre-secondary transfer stretch roller that is in contact with the inner peripheral surface of the intermediate transfer belt to stretch the intermediate transfer belt but does not transmit a driving force to the intermediate transfer belt is provided at a position downstream of the primary transfer rollers and upstream of a secondary transfer nip portion in a direction in which the intermediate transfer belt rotates.

Condition 3: A driving roller that transmits a driving force to the intermediate transfer belt is provided at a position downstream of the pre-secondary transfer stretch roller. This condition includes a case where a secondary transfer inner roller is also used as the driving roller.

Condition 4: The peripheral speed of the driving roller is faster than the peripheral speeds of the photosensitive drums.

Condition 5: DC electrifiers for electrifying photosensitive drums for respective colors via a DC system are provided, and the DC electrifiers for Y, M, C, and Bk are on when performing printing in the monochromatic mode.

Condition 6: Developing bias power sources that are capable of applying developing biases are provided for respective colors.

Condition 7: Rotation of developing sleeves can be switched on and off for each color, and, when performing printing in the monochromatic mode, the rotation of a developing sleeve for Bk is turned on and the rotation of developing sleeves for Y, M, and C is turned off.

Condition 7 is a condition for avoiding deterioration of developer in developer containers for Y, M, and C caused by unnecessary rotation of the developing sleeves for Y, M, and C in a case where the rotation of the developing sleeves for Y, M, and C that are not used for image formation is turned on.

In charging of a DC system, the potential of a photosensitive drum before charging is likely to affect the potential of the photosensitive drum after charging. If the primary transfer biases are turned off, the charging potentials of the photosensitive drums for Y, M, and C become higher than the potential of the photosensitive drum for Bk. In this case, carrier attachment occurs even if the rotation of the developing sleeves is turned off. Condition 1 is provided to avoid this problem.

Cause of Bk Image Defect

It has been revealed that, if the monochromatic mode is executed in a state where at least Conditions 1 to 5 are satisfied among Conditions 1 to 7 described above, the intermediate transfer belt may be loosened in a section between the pre-secondary transfer stretch roller and the driving roller. In the case where the intermediate transfer belt is loosened in this section, it becomes more difficult to bring a recording material, for example, a paper sheet, and the intermediate transfer belt into firm contact with each other in the vicinity of the secondary transfer nip portion when performing secondary transfer, and thus an abnormal electric discharge may occur between the intermediate transfer belt and the recording material. This electric discharge causes a problem of a defect in a black image in which Bk toner is not normally transferred onto a part of the recording material. In Condition 6, DC voltages are applied to the photosensitive drums for Y, M, and C, on which images are not to be formed, because the photosensitive drums for Y, M, and C are electrified and carrier attachment may occur unless the developing biases are applied thereto. In Condition 7, the rotation of the developing sleeves for Y, M, and C is stopped in order to suppress the deterioration of developer.

Cause of Loosening of Intermediate Transfer Belt

In a full-color image forming apparatus employing a tandem system, the speed of the intermediate transfer belt is sometimes set such that speed differences including tolerances between the intermediate transfer belt and the photosensitive drums include only 0% or positive values or only 0% or negative values. Specifically, since the speed tolerances are typically in the range of about ±0.5%, the peripheral speed of the driving roller, that is, the speed of the intermediate transfer belt, is set to about +0.5% such that the conveyance speed of the intermediate transfer belt is as fast as or faster than the rotation speeds of the photosensitive drums.

In the full-color mode, toner images corresponding to image information are formed on the photosensitive drums for respective colors. In the full-color mode, the developing biases are applied in image forming portions for all colors, and developing sleeves for all colors are driven even in the case where the image information does not include components of the respective colors. Thus, toner of such a small amount that does not affect the image quality is attached to the photosensitive drums. Toner particles on the photosensitive drums function as a friction reduction agent between the photosensitive drums and the intermediate transfer belt even when used in a small amount. The toner particles also have an effect of reducing a load resistance deriving from an electrostatic attraction force between the photosensitive drums and the intermediate transfer belt generated by the primary transfer biases. Therefore, due to the toner functioning as a friction reduction agent, a large load is not applied to the driving roller and thus the driving roller is less likely to slip on the intermediate transfer belt even in the case where the peripheral speed of the driving roller driving the intermediate transfer belt is set to be faster than the peripheral speeds of the photosensitive drums. Accordingly, the occurrence of loosening of the intermediate transfer belt in the section between the pre-secondary transfer stretch roller and the driving roller is suppressed.

However, in the monochromatic mode, since images of Y, M, and C are not to be formed, toner images are not formed on the photosensitive drums for these three colors. Further, in the case where the developing biases for Y, M, and C are turned off and the rotation of the developing sleeves is turned off as in Conditions 6 and 7, the small amount of toner on the photosensitive drums functioning as a friction reduction agent is hardly present.

Moreover, in the case where primary transfer biases as high as or higher than in the full-color mode are applied to the primary transfer rollers for Y, M, and C as in Condition 1 and the DC electrifiers are turned on as in Condition 5, the photosensitive drums for these three colors and the intermediate transfer belt are firmly in contact with each other as a result of a strong electrostatic attraction force evoked by the primary transfer biases, and thus a large driving load is applied to the driving roller rotating at a peripheral speed faster than the peripheral speeds of the photosensitive drums as in Condition 4. In the case where the driving load exceeds the frictional force between the driving roller and the intermediate transfer belt, the driving roller slips, and thus the intermediate transfer belt becomes slower. On the premise that the intermediate transfer belt has become slower, in the case where the speed of the intermediate transfer belt is still faster than the speed of the photosensitive drums, the intermediate transfer belt between the pre-secondary transfer stretch roller and the driving roller is not loosened because the intermediate transfer belt is pulled upstream by the photosensitive drums and downstream by the driving roller in the moving direction of the intermediate transfer belt. However, in the case where, for example, the accumulated use time of the intermediate transfer belt increases, attachment of powder generated from wear, scattered toner, and the like to a portion between the driving roller and the intermediate transfer belt increases, and thus the frictional force is reduced and the degree of slip becomes larger. In the case where the speed of the intermediate transfer belt becomes slower than the peripheral speed of the photosensitive drums, the photosensitive drums may push the intermediate transfer belt downstream in the moving direction due to the electrostatic attraction force between the photosensitive drums and the intermediate transfer belt, and thus the intermediate transfer belt may be loosened between the pre-secondary transfer stretch roller and the driving roller. In the case where the intermediate transfer belt is loosened in a portion in the vicinity of and upstream of the driving roller, the driving force of the driving roller transmitted to the intermediate transfer belt is reduced, and thus the state in which the intermediate transfer belt is loosened between the pre-secondary transfer stretch roller and the driving roller is maintained.

In the case where the intermediate transfer belt is loosened between the pre-secondary transfer stretch roller and the driving roller, it becomes difficult to bring the intermediate transfer belt and a recording material such as a paper sheet in firm contact with each other in secondary transfer, and thus an image defect occurs due to an abnormal electric discharge between the intermediate transfer belt and the recording material.

Particularly in recent years, rubber rollers formed of, for example, ethylene propylene diene monomer: EPDM, are produced in smaller diameters in order to reduce the cost thereof. However, in the case where the driving roller is produced in a smaller diameter, the contact area of the driving roller with the intermediate transfer belt becomes smaller. In this case, the contact between the driving roller and the intermediate transfer belt is more likely to be affected by the friction reduction caused by attachment of toner or the like to the driving roller, and there is a tendency that the driving roller is more likely to slip in the case where the driving load increases as in the monochromatic mode described above.

For the reasons described above, a problem that a part of an image to be printed black is not printed and the image becomes partially lacking occurs in the case where the monochromatic mode is executed in accordance with the conditions described above.

According to an aspect of the present invention, DC charging biases are applied to charging portions for Y, M, and C for which image formation is not performed, and developing sleeves for Y, M, and C are stopped in the case of executing the monochromatic mode. Voltages are applied to developing bias portions for Y, M, and C. Further, biases smaller than the primary transfer biases applied in the case of executing the full-color mode is applied to the primary transfer rollers for Y, M, and C. Here, applying the smaller biases does not include a state where bias power sources are turned off.

First Exemplary Embodiment

Figure 1:
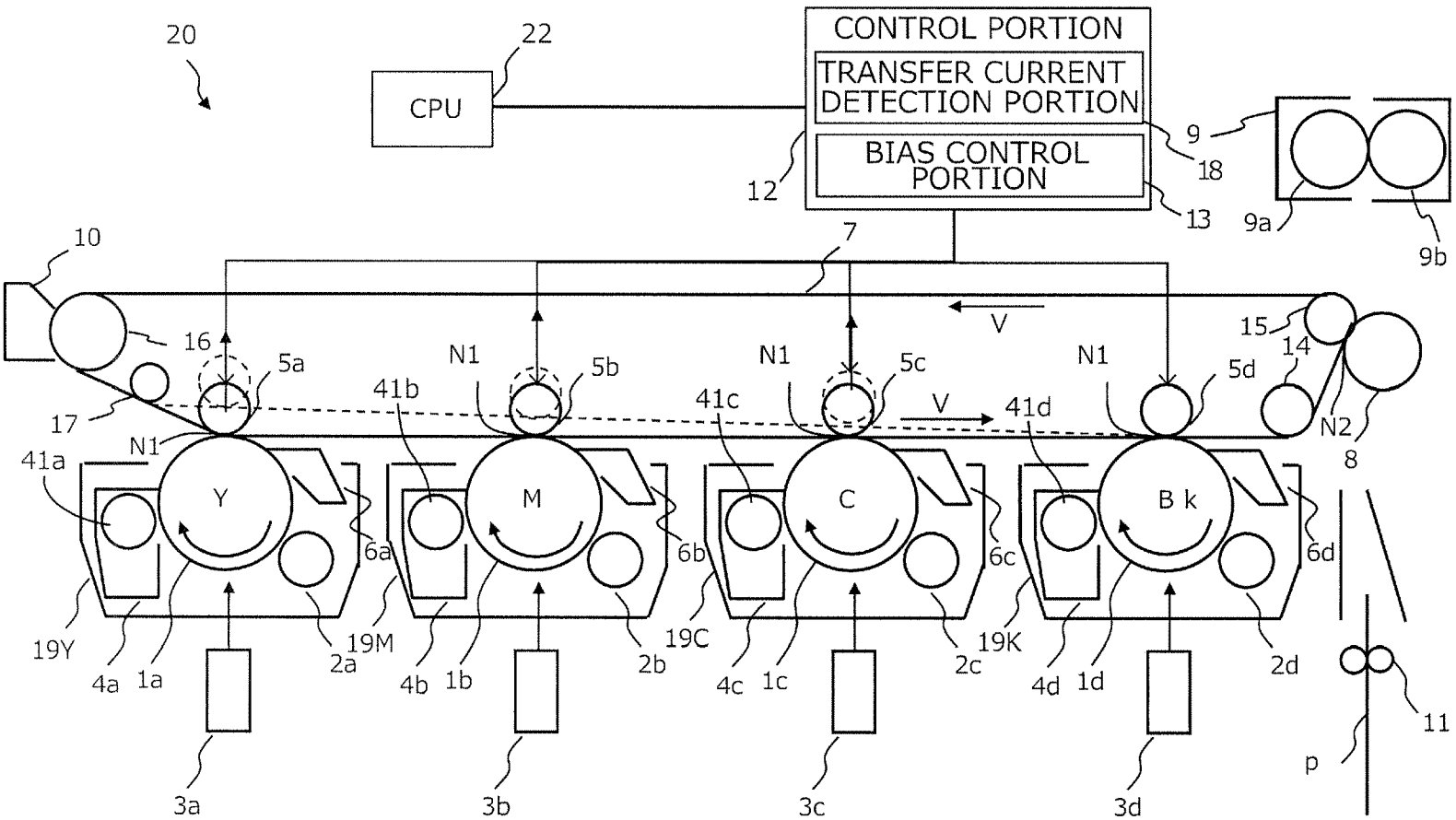
FIG. 1 is a schematic configuration diagram of an image forming apparatus according to a first exemplary embodiment.

An image forming apparatus according to a first exemplary embodiment of the present invention will be described with reference to drawings. FIG. 1 illustrates an image forming apparatus 20 employing a tandem system in which image forming portions 19Y, 19M, 19C, and 19K are arranged along an intermediate transfer belt 7 that is a rotatable endless belt.

The four image forming portions 19Y to 19K are arranged in a line with constant intervals therebetween. The image forming portion 19Y forms an image with yellow toner, the image forming portion 19M forms an image with magenta toner, the image forming portion 19C forms an image with cyan toner, and the image forming portion 19K forms an image with black toner. The image forming portions 19Y to 19K are the same in configuration except for the colors of toner.

The image forming portions 19Y to 19K respectively include photosensitive drums 1*a*, 1*b*, 1*c*, and 1*d*, charging rollers 2*a*, 2*b*, 2*c*, and 2*d*, and exposing units 3*a*, 3*b*, 3*c*, and 3*d*. The image forming portions 19Y to 19K further respectively include developing units 4*a*, 4*b*, 4*c*, and 4*d*, primary transfer rollers 5*a*, 5*b*, 5*c*, and 5*d*, and photosensitive drum cleaners 6*a*, 6*b*, 6*c*, and 6*d*.

The photosensitive drums 1*a*, 1*b*, and 1*c* each serving as a first image bearing member and the photosensitive drum 1*d* serving as a second image bearing member are rotatable drums that respectively bear toner images of Y, M, C, and Bk. The photosensitive drums 1*a* to 1*d* according to the present exemplary embodiments are each an organic photoconductor: OPC of a negative charge type having an outer diameter of 30 mm. These photosensitive drums 1*a* to 1*d* are each driven by a drum driving motor serving as a photoconductor driving portion that is not illustrated to rotate in a direction indicated by an arrow in FIG. 1.

Alternatively, the photosensitive drums 1*b* and 1*c* may respectively serve as third and fourth image bearing members while the photosensitive drum 1*a* serves as the first image bearing member and the photosensitive drum 1*d* serves as the second image bearing member.

The charging rollers 2*a*, 2*b*, and 2*c* serving as first charging portions and the charging roller 2*d* serving as a second charging portion are rotatable rollers provided for charging of the photosensitive drums 1*a* to 1*d*. The image forming apparatus 20 according to the present exemplary embodiment employs a DC charging system in which the surfaces of the photosensitive drums 1*a* to 1*d* are electrified by DC voltages applied by the charging rollers 2*a* to 2*d*. The DC charging system does not require an alternate current power source in addition to a direct current power source unlike an AC/DC charging system, and thus suppresses the increase of costs of the image forming apparatus 20.

The surfaces of the photosensitive drums 1*a* to 1*d* are scraped through repetitive image formations. The amount of scrape is approximately 3 μm/10 thousand sheets in the AC/DC charging system in which an alternate current voltage is superposed on a direct current voltage. By contrast, the amount of scrape is approximately 1 μm/10 thousand sheets in the DC charging system. The DC charging system whose amount of scrape of the photosensitive drums 1*a* to 1*d* is smaller than the AC/DC charging system whose discharge current is larger is more advantageous in lengthening the lifetime of the photosensitive drums 1*a* to 1*d*.

The exposing units 3*a* to 3*d* serve as light sources for irradiating the electrified photosensitive drums 1*a* to 1*d* with light to form latent images. The exposing units 3*a* to 3*d* each include a laser, a polygon mirror, a correcting lens, a back mirror, and so forth. The laser outputs laser light modulated in accordance with image information.

The developing units 4*a* to 4*d* develop electrostatic latent images formed on the photosensitive drums 1*a* to 1*d* as toner images. The developing units 4*a* to 4*d* respectively include developing sleeves 41*a* to 41*d* and developing bias power sources that are not illustrated.

The developing sleeves 41*a*, 41*b*, and 41*c* serving as first developing sleeves and the developing sleeve 41*d* serving as a second developing sleeve rotate while bearing toner thereon. The developing sleeves 41*a* to 41*d* supply toner to develop the electrostatic latent images to respective photosensitive drums.

The developing bias power sources serving as first developing bias power sources included in the developing units 4*a* to 4*c* may be a so-called DC developing system that applies developing biases constituted by only DC voltages to the developing sleeves 41*a*, 41*b*, and 41*c*, and, alternatively, may be an AC developing system that applies developing biases constituted by superposing AC voltages on DC voltages to the developing sleeves 41*a*, 41*b*, and 41*c*.

The developing bias power source serving as a second developing bias power source included in the developing unit 4*d* applies a developing bias constituted by only a DC voltage or by superposing an AC voltage on a DC voltage to the developing sleeve 41*d*.

The primary transfer rollers 5*a*, 5*b*, 5*c* serving as first primary transfer members and the primary transfer roller 5*d* serving as a second primary transfer member are disposed in a space enclosed by the intermediate transfer belt 7. The primary transfer rollers 5*a* to 5*d* transfer toner images formed on the photosensitive drums 1*a* to 1*d* onto the intermediate transfer belt 7 through primary transfer at primary transfer nip portions N1 serving as primary transfer positions. Bias voltages individually controlled by a control portion 12 are applied to the primary transfer rollers 5*a* to 5*d*.

The first primary transfer members and the second primary transfer member are not limited to primary transfer rollers, and, for example, primary transfer blades may be used as the first and second primary transfer members.

The primary transfer rollers 5*a*, 5*b*, and 5*c* serving as the first primary transfer members are configured to be in contact with and separated from the photosensitive drums 1*a*, 1*b*, and 1*c* with the intermediate transfer belt 7 interposed therebetween.

When operating in the full-color mode, the primary transfer rollers 5*a* to 5*d* come into contact with and pressurize the photosensitive drums 1*a* to 1*d* through the intermediate transfer belt 7. In addition, when operating in a first monochromatic mode that will be described later, the primary transfer rollers 5*a* to 5*d* are also in contact with the photosensitive drums 1*a* to 1*d* through the intermediate transfer belt 7. By contrast, when operating in a second monochromatic mode that will be described later, the primary transfer rollers 5*a*, 5*b*, and 5*c* are in contact with the intermediate transfer belt 7 but separated from the photosensitive drums 1*a*, 1*b*, and 1*c* as indicated by broken lines in FIG. 1.

The intermediate transfer belt 7 is stretched by plural rollers in contact with the inner peripheral surface thereof. That is, the intermediate transfer belt 7 is stretched by a secondary transfer inner roller 15, a tension roller 16, and stretch rollers 14 and 17. The tension roller 16 imparts a predetermined tension force to the intermediate transfer belt 7.

The stretch roller 14 serving as a pre-secondary transfer stretch roller is disposed at the following position. That is, the stretch roller 14 is disposed downstream of the primary transfer roller 5*d* for Bk, which is the most downstream of the four primary transfer rollers 5*a* to 5*d*, and upstream of the secondary transfer outer roller 8 and the secondary transfer inner roller 15 in the rotation direction of the intermediate transfer belt 7. The stretch roller 14 forms, for example, a stretched surface of the intermediate transfer belt onto which toner images are transferred from the photosensitive drums 1*a* to 1*d* for respective colors. The stretch roller 14 is a so-called driven roller that rotates along with the rotation of the intermediate transfer belt 7.

A secondary transfer outer roller 8 serving as a secondary transfer outer member forms the secondary transfer nip portion N2 with the outer peripheral surface of the intermediate transfer belt 7. A recording material is nipped at the secondary transfer nip portion N2. As the secondary transfer outer member, a secondary transfer outer belt may be used instead of a secondary transfer outer roller.

The secondary transfer inner roller 15 also functions as a driving roller that drives the intermediate transfer belt 7. The intermediate transfer belt 7 to which a driving force is transmitted by the rotation of the driving roller, that is, the secondary transfer inner roller 15, is configured to move in a rotation direction indicated by an arrow v in FIG. 1 to convey a toner image.

A roller of a small diameter is used as the driving roller, that is, the secondary transfer inner roller 15, for miniaturization. The diameter of the secondary transfer inner roller 15 is 13 mm. A semiconductive rubber layer that is formed of a material obtained by dispersing conductive carbon in EPDM rubber and that has a thickness of 0.5 mm is used as the surface layer of the secondary transfer inner roller 15. The resistance value of the secondary transfer inner roller 15 is about $1\times10^{1}$ to $10^{5}\Omega$ when a voltage of 10 V is applied thereto in an environment of a temperature of 23° C. and a relative humidity of 50%.

The rotation peripheral speed of the driving roller is set to be 0.5% faster than the rotation peripheral speed of the photosensitive drums 1*a* to 1*d*. The process speed is 200 mm/sec, and the speed of the intermediate transfer belt 7 is set to be 0.5% faster than the rotation peripheral speed of the photosensitive drums 1*a* to 1*d* in the central value. The speed tolerance is set to be in the range of ±0.5% such that the speed of the intermediate transfer belt 7 is faster than the rotation peripheral speed of the photosensitive drums 1*a* to 1*d* even with the lower limit value of the speed tolerance.

Figure 4:
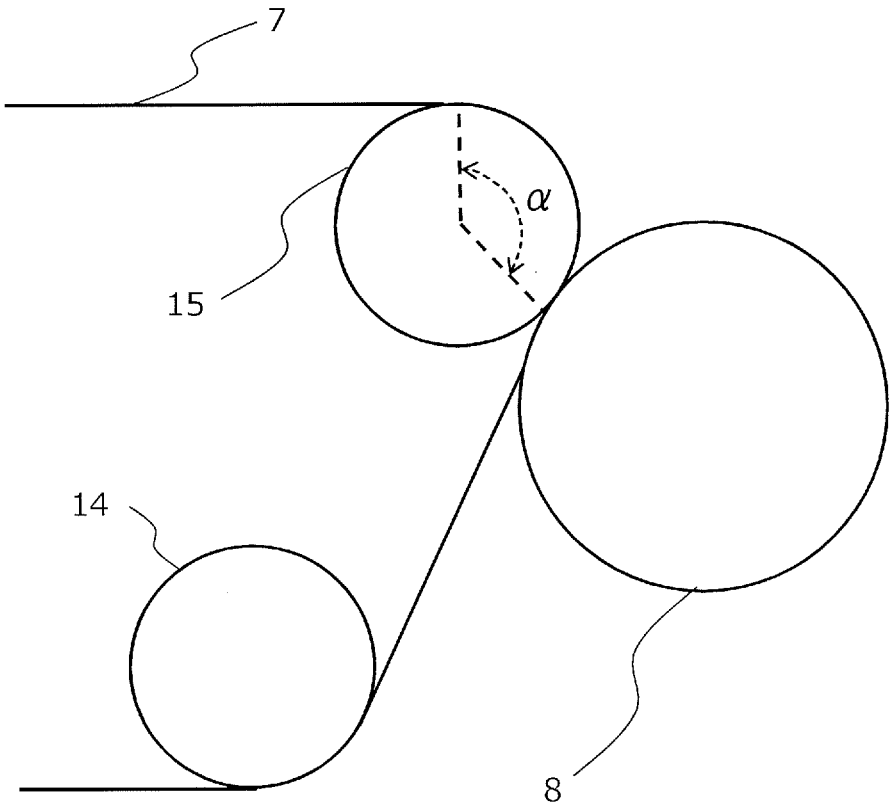
FIG. 4 is a diagram illustrating a winding angle of an intermediate transfer belt wound around a driving roller serving as a secondary transfer inner roller.

A winding angle of the intermediate transfer belt 7 with respect to the driving roller, that is, the secondary transfer inner roller 15, will be described with reference to FIG. 4. As illustrated in FIG. 4, a winding angle α of the intermediate transfer belt 7 with respect to the secondary transfer inner roller 15 is as small as 123° because a small-diameter roller of a diameter of 13 mm is used as the secondary transfer inner roller 15.

Although the image forming apparatus 20 includes the stretch rollers 14 and 17 that stretch the intermediate transfer belt 7 as described above, the number of stretch rollers is not limited to the number of stretch rollers in FIG. 1.

A fixing unit 9 includes a fixing roller 9*a* and a pressurizing roller 9*b*. The fixing roller 9*a* includes a heater serving as a heat source therein, and the pressurizing roller 9*b* is urged against the fixing roller 9*a*. Among various configurations and types of fixing units, the fixing unit 9 illustrated in FIG. 1 is a type of fixing unit that melts toner on the recording material and fixes the toner as a toner image by applying a predetermined pressurizing force and heat to the recording material in a fixing nip portion formed by two opposing rollers of the fixing roller 9*a* and the pressurizing roller 9*b*.

An intermediate belt cleaner 10 removes toner remaining on the intermediate transfer belt 7 without being transferred onto the recording material P through secondary transfer.

The image forming apparatus 20 includes a CPU 22 and the control portion 12.

The CPU 22 transmits various operation signals and controls each component of the image forming apparatus 20 in an integrated manner. The CPU 22 controls execution of the full-color mode, the first monochromatic mode, and the second monochromatic mode that will be described later.

The control portion 12 includes a bias control portion 13, a transfer current detection portion 18, and memories such as a read only memory: ROM and a random access memory: RAM that are not illustrated. The bias control portion 13 controls, for each primary transfer roller, whether a bias voltage is applied between the primary transfer rollers 5*a* to 5*d* and the photosensitive drums 1*a* to 1*d*, and, in the case of applying the bias voltage, the value of the bias voltage by controlling a power source that is not illustrated. In addition, the bias control portion 13 applies a secondary transfer bias between the secondary transfer outer roller 8 and the secondary transfer inner roller 15 by controlling the power source that is not illustrated.

The transfer current detection portion 18 is used for setting voltages to be applied to the primary transfer rollers 5*a* to 5*d* in primary transfer. The transfer current detection portion 18 detects transfer currents flowing between the primary transfer rollers 5*a* to 5*d* and the photosensitive drums 1*a* to 1*d*. The transfer current detection portion 18 applies voltages to the primary transfer rollers 5*a* to 5*d* ahead of image formation to detect currents flowing in the primary transfer nip portions N1 serving as primary transfer portions. The voltage applied in primary transfer is set on the basis of the values detected in this way.

For simpler explanation of the monochromatic modes according to the present exemplary embodiment, the operations of each component of the apparatus in formation of a full-color image will be described first.

Formation of Full-Color Image

The operation of the image forming apparatus 20 in formation of a full-color image will be described. First, the surfaces of the photosensitive drums 1*a* to 1*d* are respectively subjected to uniform DC charging by charging rollers 2*a* to 2*d*.

Then, laser light modulated in accordance with image signals of respective colors is output by the exposing units 3*a* to 3*d* each including a laser and a polygon mirror correcting lens. The laser light is reflected by a back mirror, and exposes each of the electrified photosensitive drums 1*a* to 1*d*. In this way, electrostatic latent images corresponding to the image signals are formed on the photosensitive drums 1*a* to 1*d* for respective colors. The electrostatic latent images respectively formed on the photosensitive drums 1*a* to 1*d* are developed by the developing units 4*a* to 4*d*, and thus toner images of respective colors are formed on the photosensitive drums 1*a* to 1*d*.

After that, the toner images of respective colors are sequentially transferred onto the intermediate transfer belt 7 by the primary transfer rollers 5*a* to 5*d* each subjected to a predetermined pressurizing force and a primary transfer bias applied thereto. In this way, the toner images of different colors are sequentially formed on the intermediate transfer belt 7 so as to be superposed on one another, and thus a full-color image is formed on the intermediate transfer belt 7. To be noted, although the number of colors used in the present exemplary embodiment is four, the number of colors is not limited to four, and the arrangement order of the colors is not limited to the present exemplary embodiment.

Toner remaining on the photosensitive drums 1*a* to 1*d* without being transferred is collected by the photosensitive drum cleaners 6*a* to 6*d*.

Image formation processes of respective colors are performed in parallel by the image forming portions 19Y to 19K at such timings that each toner image is superposed on another toner image formed by more upstream image forming portion via primary transfer onto the intermediate transfer belt 7. As a result of this, a full-color toner image is finally formed on the intermediate transfer belt 7, and is conveyed to the secondary transfer nip portion N2 serving as a secondary transfer portion. The secondary transfer nip portion nips the recording material P between the outer peripheral surface of the intermediate transfer belt 7 and the secondary transfer outer roller 8.

The full-color toner image formed on the outer peripheral surface of the intermediate transfer belt 7 is transferred onto the recording material P conveyed by a conveyance roller 11 at the secondary transfer nip portion N2 through secondary transfer. Then, the recording material P is conveyed to the fixing unit 9, and the toner image is melted and fixed onto the recording material P.

Formation of Monochromatic Image

The image forming apparatus is capable of executing the first monochromatic mode or the second monochromatic mode under control by the CPU 22 in formation of a monochromatic image. These modes will be described sequentially.

First Monochromatic Mode

In the first monochromatic mode, as illustrated by a solid line in FIG. 1, the primary transfer rollers 5*a* to 5*d* are in contact with the photosensitive drums 1*a* to 1*d* through the intermediate transfer belt 7. DC voltages are applied to the charging rollers 2*a* to 2*d*. The DC voltages are applied to the charging rollers 2*a*, 2*b*, and 2*c* of image forming portions that do not perform image formation because the charging performance and the degree of convergence of potential of the DC charging system is low compared with a charging system in which AC voltages are superposed on DC voltages. Therefore, in the case where, for example, the DC voltages are kept off, it takes long time to raise the potentials of the photosensitive drums 1*a*, 1*b*, and 1*c* to predetermined potentials when electrifying the photosensitive drums 1*a*, 1*b*, and 1*c* for the next image formation. Accordingly, in the first monochromatic mode, the DC voltages are also applied to the charging rollers 2*a*, 2*b*, and 2*c*.

In the developing units 4*a*, 4*b*, and 4*c*, only DC voltages, or DC voltages on which AC voltages are not superposed, are applied to the developing sleeves 41*a*, 41*b*, and 41*c*, and the rotation of the developing sleeves 41*a*, 41*b*, and 41*c* is stopped. The voltages are applied in the developing units 4*a*, 4*b*, and 4*c* because the photosensitive drums 1*a*, 1*b*, and 1*c* are electrified by the charging rollers 2*a*, 2*b*, and 2*c* and carrier will attach to the photosensitive drums 1*a*, 1*b*, and 1*c* due to potential differences unless the voltages are applied. The rotation of the developing sleeves 41*a*, 41*b*, and 41*c* is stopped in order to suppress the deterioration of developer. In the developing unit 4*d*, only a DC voltage or a DC voltage on which an AC voltage is superposed is applied to the developing sleeve 41*d*, and the developing sleeve 41*d* is rotated.

A bias voltage V1 is applied to the primary transfer rollers 5*a*, 5*b*, and 5*c* for Y, M, and C. A primary transfer bias is applied to the primary transfer roller 5*d* for Bk so as to transfer Bk toner onto the intermediate transfer belt 7. If a voltage equal to the primary transfer bias is applied to the primary transfer rollers 5*a*, 5*b*, and 5*c*, the intermediate transfer belt 7 will be loosened between the pre-secondary transfer stretch roller and the driving roller due to an electrostatic attraction force between the intermediate transfer belt 7 and the photosensitive drums 1*a*, 1*b*, and 1*c* as described above. In addition, in the case where the primary transfer bias applied to the primary transfer rollers 5*a*, 5*b*, and 5*c* is turned off, the potentials of the photosensitive drums 1*a*, 1*b*, and 1*c* are raised. This may cause attachment of carrier or the like to the photosensitive drums 1*a*, 1*b*, and 1*c*. Therefore, the bias control portion 13 controls the bias voltage V1 to be smaller than a primary transfer bias applied to the primary transfer rollers 5*a*, 5*b*, and 5*c* for Y, M, and C in the full-color mode.

As a specific example of a preferable condition, the bias voltage V1 may be controlled to be 0.2 to 0.7 times as large as the primary transfer bias applied to the primary transfer rollers 5*a*, 5*b*, and 5*c* for Y, M, and C in the full-color mode.

Controlling the bias voltage V1 to be 0.2 or more times as large as the primary transfer bias stabilizes operations in the first monochromatic mode and shortens the time taken for transition to the full-color mode. This point will be described in association with the relationship with the temporal change of surface potential of a photosensitive drum.

Figure 2A:
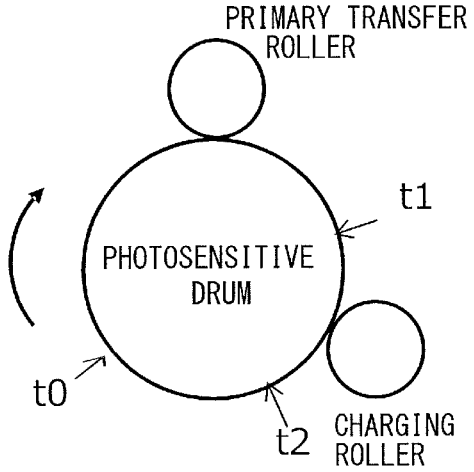
FIG. 2A is a rotation timing chart of a photosensitive drum.

First, FIG. 2A is a diagram illustrating a relationship between positions on and rotational timings of the photosensitive drum as preliminary information for explanation of the surface potential of the photosensitive drum. In FIG. 2A, a period from a time at which a point on the photosensitive drum rotating in an arrow direction passes by a charging roller to a time at which the point reaches a primary transfer roller is illustrated as t0, a period from a time at which the point passes by the primary transfer roller to a time at which the point reaches the charging roller again is illustrated as t1, and a period from a time at which the point passes by the charging roller in the second rotation to a time at which the point reaches the primary transfer roller in the second rotation is illustrated as t2.

Figure 2B:
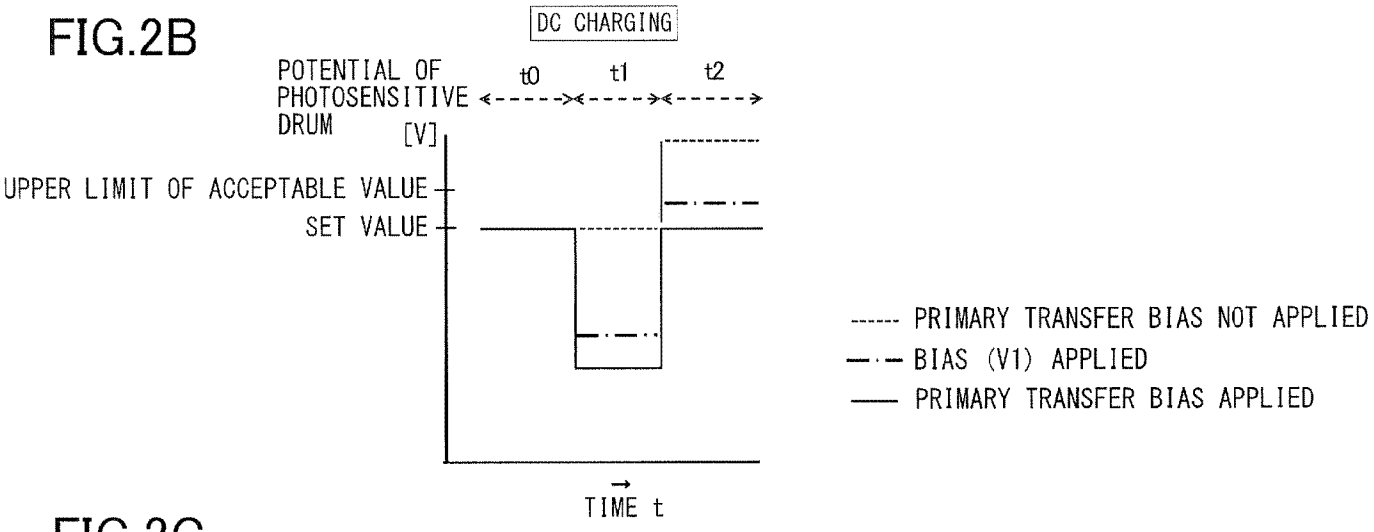
FIG. 2B is a diagram illustrating a potential change of a photosensitive drum in a DC charging system.

FIG. 2B illustrates the surface potential of the photosensitive drum in each timing of t0, t1, and t2 in the DC charging system according to the present exemplary embodiment. In FIG. 2B, a case where a DC charging voltage is applied to the photosensitive drum and a primary transfer bias is applied to the primary transfer roller in the full-color mode is indicated by a solid line. In contrast, a case where the DC charging voltage is applied to the photosensitive drum and the primary transfer bias is turned off is indicated by a dotted line.

Figure 2C:
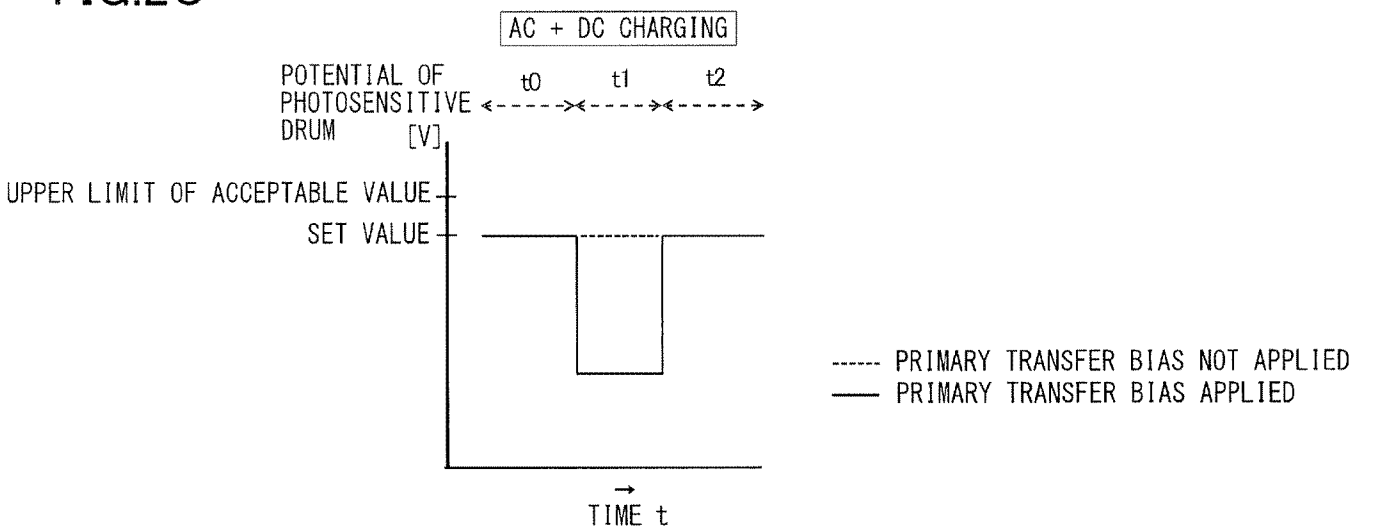
FIG. 2C is a diagram illustrating a potential change of the photosensitive drum in an AC+DC charging method.

For comparison, FIG. 2C illustrates the surface potential of the photosensitive drum in a DC+AC charging system in which an AC voltage is superposed on a DC voltage. A case where a DC+AC charging voltage is applied to the photosensitive drum and the primary transfer bias is applied to the primary transfer roller is indicated by a solid line. In contrast, a case where the DC+AC charging voltage is applied to the photosensitive drum and the primary transfer bias is turned off is indicated by a dotted line.

In the case where a point on the photosensitive drum having been subjected to a charging bias applied thereto passes by the primary transfer roller to which the primary bias is applied, the surface potential of the photosensitive drum is lowered as indicated by a part of the graph corresponding to the t1 period. Then, the point passes by the charging roller again and is re-electrified to the surface potential indicated by a part of the graph corresponding to the t2 period.

As can be seen from the solid-line graphs of FIG. 2B and FIG. 2C, the potential of the photosensitive drum re-electrified in t2 has no problem in the case where the primary transfer bias is applied. However, in the case of the DC charging system, the potential of the re-electrified photosensitive drum becomes higher than a set value in t2 as indicated by the dotted line unless the primary transfer bias is applied. Since the degree of convergence of potential of the DC charging system is low compared with the AC+DC charging system, the potential of the photosensitive drum after re-charging becomes higher than the set value in the case where the potential of the photosensitive drum before re-charging is not lower than a certain value.

In the case where the potential of the photosensitive drum is raised, the potential difference from the developing bias becomes wider. This may cause, for example, unexpected attachment of carrier to the photosensitive drum. That is, this may make it impossible to successively execute the first monochromatic mode. In addition, in the case of performing printing in the full-color mode after performing printing in the first monochromatic mode in succession, it is required to rotate the photosensitive drum in order to settle the potential to a predetermined charging potential again. This causes a time loss corresponding to one rotation or more.

Thus, in the first monochromatic mode according to the present exemplary embodiment, the predetermined bias voltage V1 is applied to the primary transfer roller in addition to application of a DC charging bias to the photosensitive roller to keep the potential difference between the photosensitive drum and the developing bias in a predetermined range. In FIG. 2B, the potential of the photosensitive drum in the case where the bias voltage V1 is applied to the primary transfer roller is indicated by a chain line. For the potential of the photosensitive drum to be stabilized in a range below an upper limit of an acceptable value in t2, that is, in the period after re-charging, the bias voltage V1 is preferably 0.2 or more times as large as the primary transfer bias applied in the full-color mode.

Figure 7:
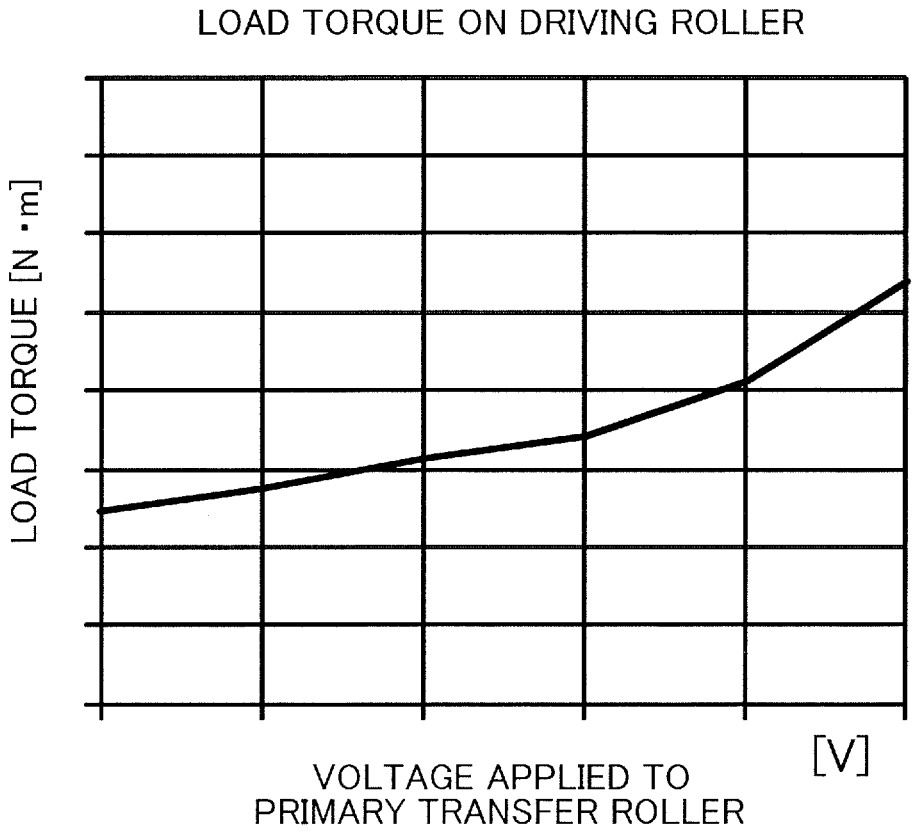
FIG. 7 is a graph illustrating a relationship between voltages applied to a primary transfer roller and a load torque of a driving roller.

In addition, by controlling the bias voltage V1 to be 0.7 or less times as large as the primary transfer bias, the electrostatic attraction force occurring in image forming portions for Y, M, and C can be suppressed, and thus the slip of the driving roller can be suppressed. FIG. 7 is a graph illustrating load torques applied to the driving roller when the voltage applied to the primary transfer roller is changed. It can be seen that, in the case where the voltage applied to the primary transfer roller is increased, the electrostatic attraction force, that is, the force binding the intermediate transfer belt, is increased, and thus the load torque applied to the driving roller generated due to a speed difference from the photosensitive drum is increased. In order to prevent the driving roller from slipping in the first monochromatic mode in the case where the driving roller has a small diameter and the frictional force thereof is sensitive to uncleanness of the surface thereof, the bias voltage V1 is preferably controlled to be 0.7 or less times as large as the primary transfer bias applied in the full-color mode.

Figure 3:
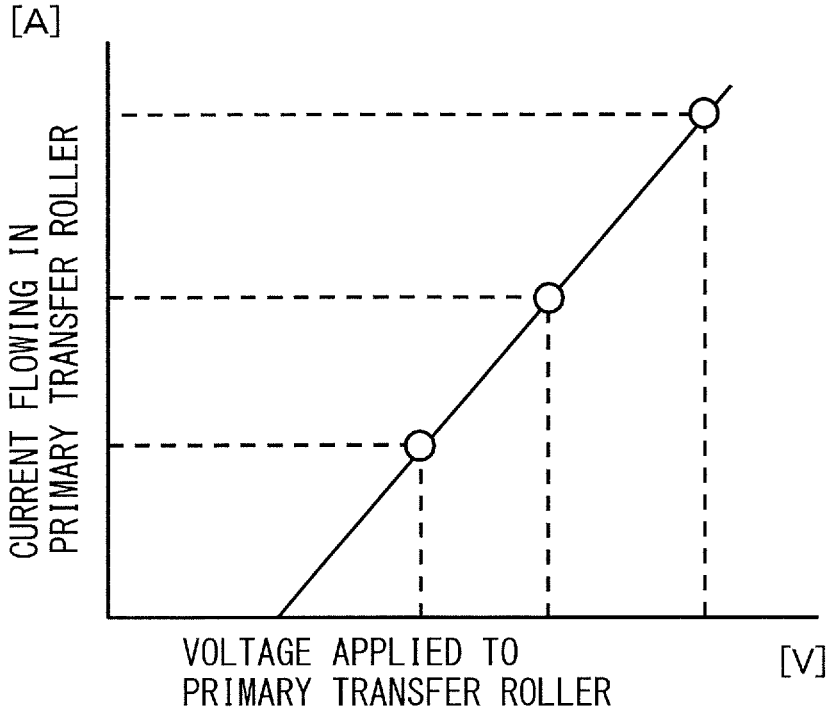
FIG. 3 is a diagram illustrating a relationship between voltages and currents applied to a primary transfer roller.

In the present exemplary embodiment, a primary transfer current flowing in the primary transfer roller is measured in order to control the voltage applied to the primary transfer roller. As illustrated in FIG. 3, there is a correlation between the voltage applied to the primary transfer roller and the current flowing in the primary transfer roller. Accordingly, to apply a desired bias voltage, the bias voltage may be controlled by measuring the primary transfer current and using the correlation illustrated in FIG. 3.

For example, in the present exemplary embodiment, while the primary transfer current is 24 μA in formation of a full-color image, the bias voltage applied to the primary transfer roller is set to such a value that the current value is 6 μA, which is one quarter of the primary transfer current in formation of a full-color image, in the first monochromatic mode. According to this, the load torque applied to the driving roller illustrated in FIG. 7 can be reduced by about 33%, and thus the slip of the driving roller can be suppressed.

Control of the voltage applied to the primary transfer roller is not limited to this method. Any method can be employed as long as the bias voltage V1 applied to the primary transfer rollers 5*a*, 5*b*, and 5*c* for Y, M, and C in the first monochromatic mode is controlled to be smaller than the primary transfer bias applied to these primary transfer rollers in the full-color mode. For example, the control portion 12 may instruct a source of the bias voltage to output voltage of a preset value without measuring the primary transfer current flowing in the primary transfer roller.

Under the operation condition described above, a black and white image is formed in the first monochromatic mode. That is, in the image forming portions 19Y, 19M, 19C, and 19K, toner images are not formed on the photosensitive drums 1*a*, 1*b*, and 1*c* of the image forming portions 19Y, 19M, and 19C. A Bk toner image is formed on the photosensitive drum 1*d* of the image forming portion 19K, is transferred onto the intermediate transfer belt 7 through primary transfer, and is transferred onto the recording material P at the secondary transfer nip portion N2 through secondary transfer. The fixing operation and cleaning of the intermediate transfer belt 7 are performed in similar manners to the full-color mode.

In the first monochromatic mode, since the intermediate transfer belt 7 is in contact with the photosensitive drums 1*a*, 1*b*, and 1*c*, transition from the full-color mode to the first monochromatic mode can be performed without a time loss. In addition, since the potentials of the photosensitive drums 1*a*, 1*b*, and 1*c* after re-charging are stabilized in a range not exceeding an upper limit of an acceptable value, monochromatic printing can be performed successively without unnecessary attachment of carrier. Further, since the intermediate transfer belt 7 is in contact with the photosensitive drums 1*a*, 1*b*, and 1*c* and the potentials of the photosensitive drums 1*a*, 1*b*, and 1*c* after re-charging are stabilized, a time loss does not occur in the case of performing printing in the full-color mode after the first monochromatic mode in succession.

Since the developing sleeves for Y, M, and C are stopped during the first monochromatic mode, stress on toner of these three colors can be reduced, and thus deterioration of toner can be suppressed.

Second Monochromatic Mode

In the second monochromatic mode, the primary transfer rollers 5*a*, 5*b*, and 5*c* are disposed at positions away from the photosensitive drums 1*a*, 1*b*, and 1*c* such that the intermediate transfer belt 7 is not in contact with the photosensitive drums 1*a*, 1*b*, and 1*c*. Whereas DC voltages are not applied to the charging rollers 2*a* to 2*c*, a DC voltage is applied to the charging roller 2*d*. Bias voltages are not applied to the primary transfer rollers 5*a*, 5*b*, and 5*c* for Y, M, and C. The primary transfer bias for transferring Bk toner onto the intermediate transfer belt 7 is applied to the primary transfer roller 5*d* for Bk. No voltage is applied to the developing units 4*a*, 4*b*, and 4*c*, and the developing sleeves thereof are not driven. Only a DC voltage or a DC voltage on which an AC voltage is superposed is applied to the developing unit 4*d*, and the developing sleeve thereof is driven.

Under the operation condition described above, a black and white image is formed in the second monochromatic mode. That is, in the image forming portions 19Y, 19M, 19C, and 19K, toner images are not formed on the photosensitive drums 1*a* to 1*c* of the image forming portions 19Y, 19M, and 19C. A Bk toner image is formed on the photosensitive drum 1*d* of the image forming portion 19K, is transferred onto the intermediate transfer belt 7 through primary transfer, and is transferred onto a recording material P at the secondary transfer nip portion N2 through secondary transfer. The fixing operation and cleaning of the intermediate transfer belt 7 are performed in similar manners to the full-color mode.

The second monochromatic mode has a merit that wear of the other photosensitive drums than the photosensitive drum for Bk can be prevented because the other photosensitive drums are separated from the intermediate transfer belt 7.

Sequence of Successive Printing

Next, an example of a sequence performed in the case where the image forming apparatus 20 according to the first exemplary embodiment prints a full-color image and a monochromatic image in succession will be described. A state in which the image forming apparatus 20 continues printing without transitioning to a stand-by state as in the case where, for example, plural print jobs are successively input, will be referred to as a state in which a connected job is input, for convenience of description. Typically, this state corresponds to a case where a next print job is input before image formation of a previous print job is finished. Here, a print job corresponds to a period from the start of image formation based on a printing signal for image formation on a recording material to the end of the image formation. Specifically, a print job corresponds to a period from a time of pre-rotation after reception of the printing signal to a time of post-rotation, and the period includes an image formation period and an interval between sheets. The reception of the printing signal corresponds to input of a job. The pre-rotation is a preliminary operation performed before image formation, and the post-rotation is an operation performed after image formation. The interval between sheets is a period in which image formation is not performed. In the case of a connected job, at least one of post-rotation of the former job and pre-rotation of the latter job may be omitted.

Figure 5:
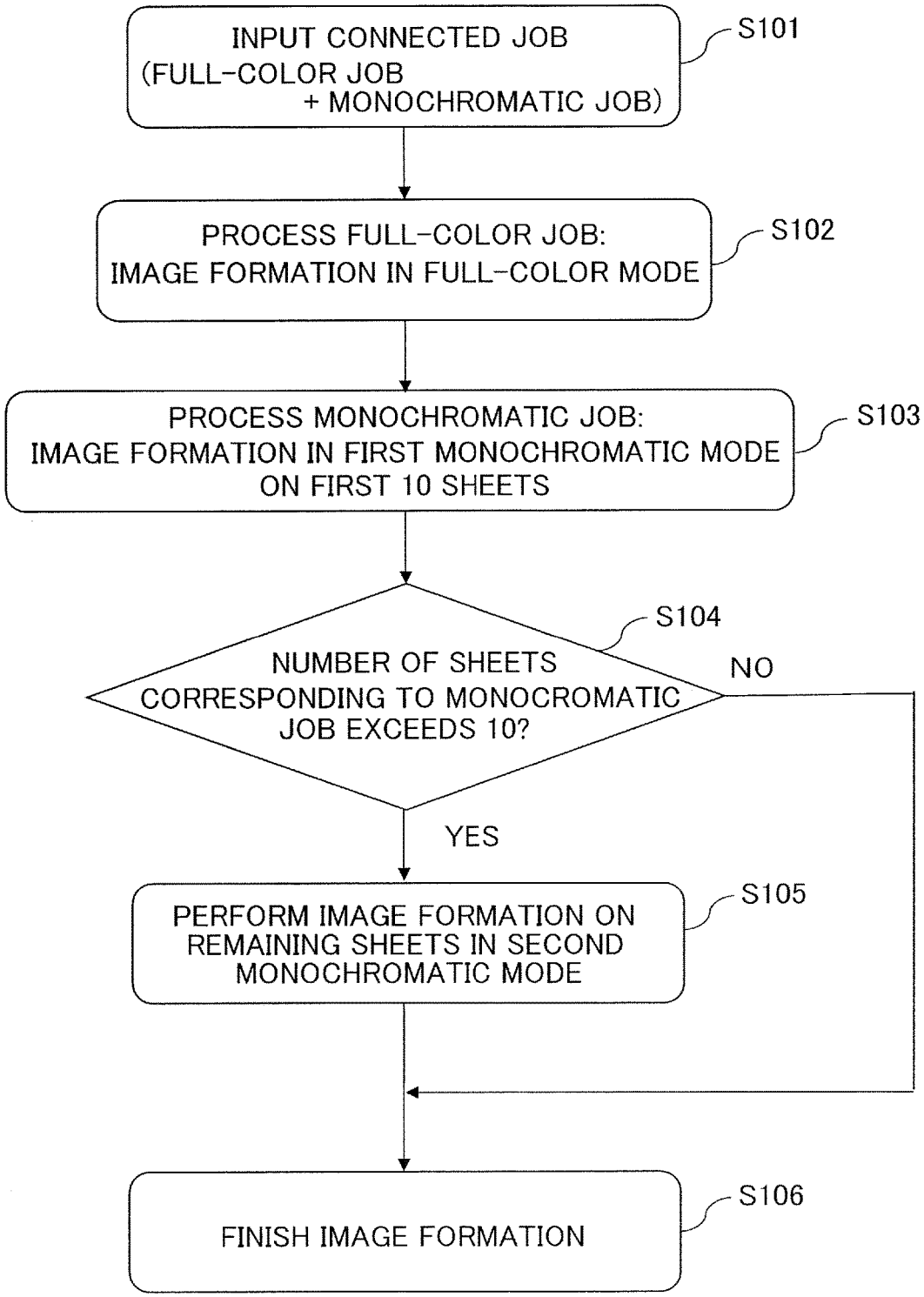
FIG. 5 is a flowchart illustrating a processing sequence of a connected job.

FIG. 5 illustrates a processing sequence of a case where a full-color job and a monochromatic job, that is, an instruction to perform full-color printing and an instruction to perform monochromatic printing, are successively input to an image forming apparatus. This case can be referred to as a case where second image formation is performed after first image formation in succession when the full-color printing is referred to as the first image formation and the monochromatic printing is referred to the second image formation.

First, in S101, a connected job of a full-color job and a monochromatic job is input. Then, in S102, the image forming apparatus executes the full-color job that has been received earlier. Subsequently, in S103, the processing transitions to execution of the monochromatic job. In S103, in the case where a predetermined number is set to 10 sheets, image formation is performed in the first monochromatic mode for the first 10 sheets. In S104, whether or not the number of sheets corresponding to the monochromatic job is equal to or below the predetermined number, that is, 10 sheets, is determined. In the case where the result of determination in S104 is YES, image formation is finished in S106. In the case where the monochromatic job still continues after the number of printed sheets exceeds 10, monochromatic printing on the remaining sheets is performed in the second monochromatic mode in S105.

This sequence is effective in the case where, for example, how many sheets are to be eventually printed in the monochromatic job in the connected job is not known in advance. This is because it can be assumed that the number of sheets to be printed is large when it is revealed that the printing still continues after 10th sheet, and thus it is better to transition to the second monochromatic mode in which wear of the photosensitive drums is smaller. Meanwhile, by forming images in the first monochromatic mode in the beginning of the monochromatic job, printing can be performed without a time loss required for separation of the photosensitive drums, and thus printing can be performed quickly in the case of printing images on a small number of sheets. As a matter of course, the predetermined number is not limited to 10 sheets and can be set as appropriate.

Figure 6:
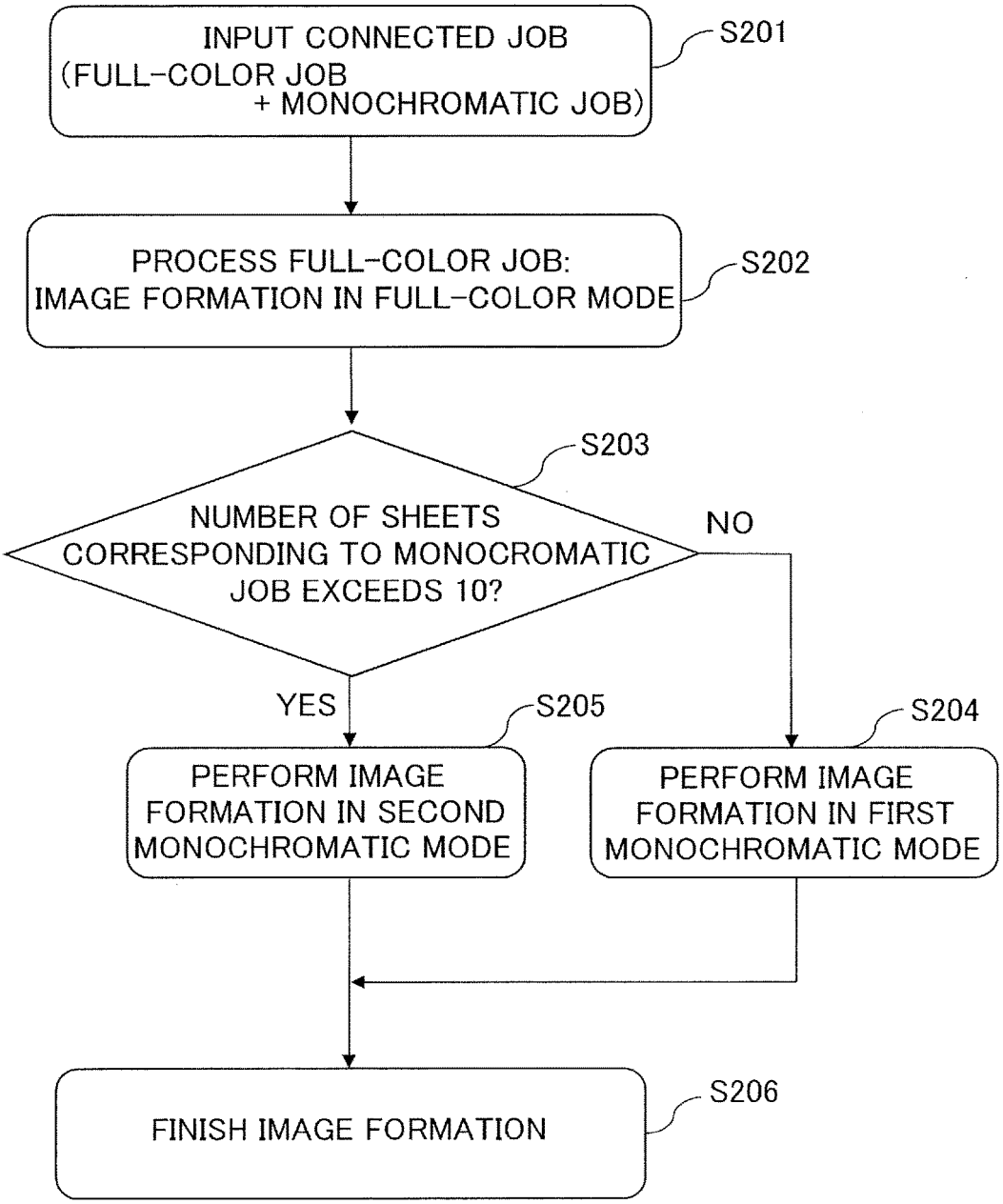
FIG. 6 is a flowchart illustrating a processing sequence of a connected job.

In the case where how many sheets are to be eventually printed in the monochromatic job in the connected job is known in advance, it is also preferable to perform a processing sequence illustrated in FIG. 6. First, in S201, a connected job of a full-color job and a monochromatic job is input. In S202, the image forming apparatus executes the full-color job that has been received earlier. Subsequently, before the processing transitions to execution of the monochromatic job, whether or not the number of sheets to be printed exceeds 10 is detected in S203. In the case where the number of sheets to be printed is equal to or smaller than 10, the first monochromatic mode is selected and image formation is performed in S204. In the case where the number of sheets to be printed exceeds 10, the second monochromatic mode is selected and image formation is performed in S205.

This sequence is effective in the case where the number of sheets to be eventually printed in the monochromatic job in the connected job is known in advance. This is because it is better to perform printing in the second monochromatic mode in which wear of the photosensitive drums is smaller from the beginning in the case where it is known that the printing continues after the number of printed sheets exceeds the predetermined number that is 10 in this example. Meanwhile, in the case where the number of sheets to be printed in the monochromatic job is equal to or smaller than the predetermined number that is 10 in this example, printing can be performed quickly by performing image formation in the first monochromatic mode in the case of printing images on a small number of sheets because printing can be performed without a time loss required for separation of the photosensitive drums.

Second Exemplary Embodiment

An image forming apparatus according to a second exemplary embodiment of the present invention will be described below.

Figure 8:
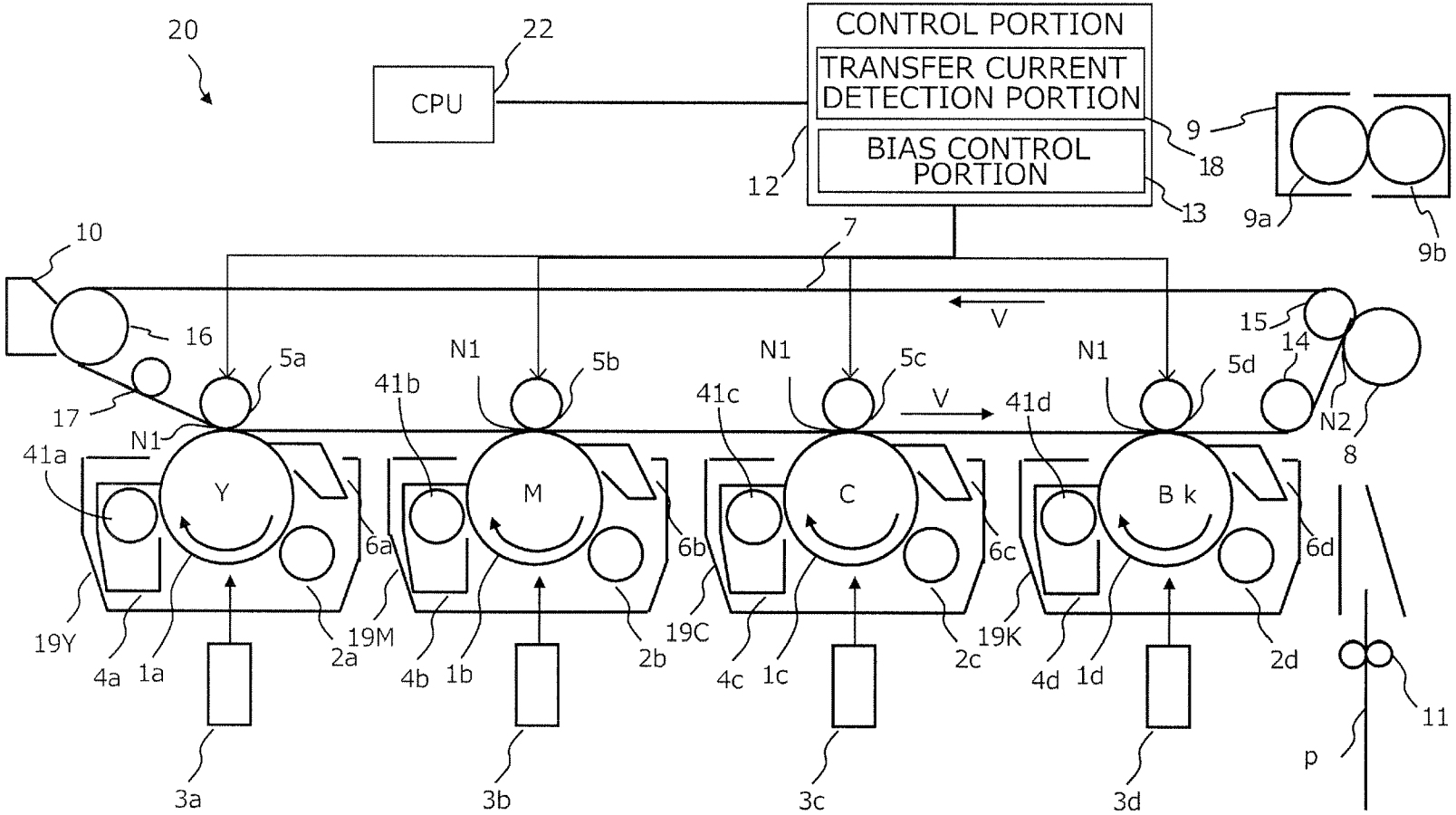
FIG. 8 is a schematic configuration diagram of an image forming apparatus according to a second exemplary embodiment.

FIG. 8 illustrates an image forming apparatus 20 employing a tandem system in which image forming portions 19Y, 19M, 19C, and 19K are arranged along an intermediate transfer belt 7 that is a rotatable endless belt.

Description of parts common with the first exemplary embodiment will be omitted. While primary transfer rollers for Y, M, and C include a contact/separation mechanism in the first exemplary embodiment, the primary transfer rollers for Y, M, and C do not include the contact/separation mechanism in the second exemplary embodiment. In the second exemplary embodiment, formation of a full-color image and formation of a monochromatic image in the first monochromatic mode is performed in the same manner as in the first exemplary embodiment.

Second Monochromatic Mode

In the second exemplary embodiment, the primary transfer rollers 5*a* to 5*d* are positioned so as to be in contact with the photosensitive drums 1*a* to 1*d* through the intermediate transfer belt 7 also in the second monochromatic mode similarly to the first monochromatic mode.

Voltage is applied to each component in the same manner as the second monochromatic mode according to the first exemplary embodiment. That is, DC voltages are not applied to the charging rollers 2*a* to 2*c* but a DC voltage is applied to the charging roller 2*d*. Bias voltages are not applied to the primary transfer rollers 5*a*, 5*b*, and 5*c* for Y, M, and C. The primary transfer bias for transferring Bk toner onto the intermediate transfer belt 7 is applied to the primary transfer roller 5*d* for Bk. No voltage is applied to the developing units 4*a*, 4*b*, and 4*c*, and developing sleeves thereof are not driven. Only a DC voltage or a DC voltage on which an AC voltage is superposed is applied to the developing unit 4*d*, and the developing sleeve thereof is driven.

Under the operation condition described above, a black and white image is formed in the second monochromatic mode. That is, in the image forming portions 19Y, 19M, 19C, and 19K, toner images are not formed on the photosensitive drums 1*a*, 1*b*, and 1*c* of the image forming portions 19Y, 19M, and 19C. A Bk toner image is formed on the photosensitive drum 1*d* of the image forming portion 19K, is transferred onto the intermediate transfer belt 7 through primary transfer, and is transferred onto a recording material P at the secondary transfer nip portion N2 through secondary transfer. The fixing operation and cleaning of the intermediate transfer belt 7 are performed in similar manners to the full-color mode.

The second monochromatic mode has a merit that, since a DC voltage is not applied to the charging rollers 2*a* to 2*c*, shortening of the lifetime of the photosensitive drums caused by unnecessary charging can be prevented.

The sequences of FIGS. 5 and 6 may be executed in the case of printing a full-color image and a monochromatic image in succession also in the apparatus according to the second exemplary embodiment similarly to the first exemplary embodiment.

The first and second exemplary embodiments described above are both related to an image forming apparatus employing a tandem system for four colors of yellow, magenta, cyan, and black. However, the application of the present invention is not limited to these exemplary embodiments. In addition, although an example in which four colors of yellow, magenta, cyan, and black are used for full-color printing and only black is used for monochromatic printing has been described, the number of image forming portions, the types and number of colors used for printing, the arrangement order of the image forming portions, the arrangement of rollers, the operation sequence, and so forth in the image forming apparatus according to the present invention are not necessarily limited to what has been described in the first and second exemplary embodiments.

For example, separate rollers may be provided as the driving roller and the secondary transfer inner roller instead of providing a single roller functioning as both of these. In this case, the driving roller may be provided as a different roller from the secondary transfer inner roller and the pre-secondary transfer stretch roller and disposed downstream of the pre-secondary transfer stretch roller.

In addition, a sequence in which the first monochromatic mode is selected in the case of prioritizing a printing speed in selection between the first and second monochromatic modes may be employed. Further, a sequence in which the second monochromatic mode is selected in the case of prioritizing the lifetime of the apparatus may be employed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-109323, filed May 31, 2016, and Japanese Patent Application No. 2017-037666, filed Feb. 28, 2017, which are hereby incorporated by reference herein in their entirety.

What is claimed is:

1. An image forming apparatus comprising:

a first image bearing member and a second image bearing member each configured to rotate while bearing a toner image;

a first charging member and a second charging member configured to respectively charge surfaces of the first image bearing member and the second image bearing member with only a DC voltage;

a first developing sleeve and a second developing sleeve each configured to rotate while bearing toner thereon;

a first developing bias power source configured to apply a developing bias to the first developing sleeve to develop a toner image on the first image bearing member;

a second developing bias power source configured to apply a developing bias to the second developing sleeve to develop a toner image on the second image bearing member;

an intermediate transfer belt configured as an endless belt and configured to come into contact with the first image bearing member and the second image bearing member on an outer peripheral surface thereof;

a first primary transfer member and a second primary transfer member disposed in a space enclosed by the intermediate transfer belt and configured to respectively transfer, by being subjected to a primary transfer bias applied thereto, toner images formed on the first image bearing member and the second image bearing member onto the intermediate transfer belt;

a secondary transfer member configured to form, with the outer peripheral surface of the intermediate transfer belt, a secondary transfer nip portion that nips a recording material, and transfer, by being applied with a secondary transfer bias, toner images transferred onto the intermediate transfer belt onto the recording material;

a pre-secondary transfer stretch roller disposed in a position downstream of the first primary transfer member and the second primary transfer member and upstream of the secondary transfer nip portion with respect to a rotation direction of the intermediate transfer belt, and configured to stretch the intermediate transfer belt by being in contact with an inner peripheral surface of the intermediate transfer belt;

a driving roller disposed downstream of the pre-secondary transfer stretch roller and configured to stretch the intermediate transfer belt and transmit a driving force to the intermediate transfer belt by being in contact with the inner peripheral surface of the intermediate transfer belt while rotating at a peripheral speed faster than peripheral speeds at which the first image bearing member and the second image bearing member rotate; and an execution portion configured to, in a case of forming a toner image on the second image bearing member without forming a toner image on the first image bearing member and transferring the toner image formed on the second image bearing member onto the recording material via the intermediate transfer belt, execute a first monochromatic mode in which, with the first image bearing member and the second image bearing member in contact with the intermediate transfer belt, a DC charging bias is applied to the first charging member and the second charging member, rotation of the first developing sleeve is stopped, the second developing sleeve is caused to rotate, the first developing bias power source applies a predetermined developing bias to the first developing sleeve, the second developing bias power source applies a predetermined developing bias to the second developing sleeve, a bias smaller than the primary transfer bias applied to the first primary transfer member in a case where a toner image is formed on the first image bearing member is applied to the first primary transfer member, and the primary transfer bias applied to the second primary transfer member in a case where a toner image is formed on the second image bearing member is applied to the second primary transfer member.

2. The image forming apparatus according to claim 1, wherein the bias applied to the first primary transfer member is 0.2 to 0.7 times as large as the primary transfer bias applied to the first primary transfer member in a case where a toner image is formed on the first image bearing member.

3. The image forming apparatus according to claim 1, wherein, the execution portion is capable of selecting, in the case of forming a toner image on the second image bearing member without forming a toner image on the first image bearing member and transferring the toner image formed on the second image bearing member onto the recording material via the intermediate transfer belt, one of the first monochromatic mode and a second monochromatic mode in which the DC charging bias applied to the first charging member is turned off, a DC charging bias is applied to the second charging member, the rotation of the first developing sleeve is stopped, the second developing sleeve is caused to rotate, the first developing bias power source is turned off, the second developing bias power source applies a predetermined developing bias to the second developing sleeve, the bias applied to the first primary transfer member is turned off, and a primary transfer bias is applied to the second primary transfer member.

4. The image forming apparatus according to claim 3, further comprising a contact/separation mechanism configured to cause the first image bearing member and the intermediate transfer belt to be in contact with each other and separated from each other, wherein the execution portion is configured to separate the first image bearing member from the intermediate transfer belt in the second monochromatic mode.

5. The image forming apparatus according to claim 3, wherein the execution portion is configured to, in the case of forming a toner image on the second image bearing member without forming a toner image on the first image bearing member and transferring the toner image formed on the second image bearing member onto the recording material via the intermediate transfer belt, execute the first monochromatic mode in the case where image formation is to be performed on recording materials of a number equal to or less than a predetermined number, and execute the first monochromatic mode for image formation on recording materials of the predetermined number and then the second monochromatic mode for image formation on remaining recording materials in a case where image formation is to be performed successively on recording materials of a number exceeding the predetermined number.

6. The image forming apparatus according to claim 3, wherein the execution portion is configured to, in the case of forming a toner image on the second image bearing member without forming a toner image on the first image bearing member and transferring the toner image formed on the second image bearing member onto the recording material via the intermediate transfer belt, detect in advance a number of recording materials on which image formation is to be performed successively, execute the first monochromatic mode in the case where the detected number is equal to or less than a predetermined number, and execute the second monochromatic mode in the case where the detected number exceeds the predetermined number.

7. The image forming apparatus according to claim 1, wherein the execution portion is configured to, in a case where first image formation, in which toner images are formed on the first image bearing member and the second image bearing member and the toner images formed on the first image bearing member and the second image bearing member are transferred onto the recording material via the intermediate transfer belt, and second image formation, which precedes the first image formation and in which a toner image is formed on the second image bearing member without forming a toner image on the first image bearing member and the toner image formed on the second image bearing member is transferred onto another recording material via the intermediate transfer belt, are performed in succession, execute the second image formation in the first monochromatic mode.

8. The image forming apparatus according to claim 1, wherein a toner image of any one color of yellow, magenta, and cyan is formed on the first image bearing member, and a black toner image is formed on the second image bearing member.

9. The image forming apparatus according to claim 8, further comprising a third image bearing member and a fourth image bearing member, wherein a yellow toner image is formed on the first image bearing member, a magenta toner image is formed on the third image bearing member, and a cyan toner image is formed on the fourth image bearing member.

* * * * *